US010701997B2

(12) United States Patent
Huff

(10) Patent No.: US 10,701,997 B2
(45) **Date of Patent: *Jul. 7, 2020**

(54) VENTED COOLING GARMENT

(71) Applicant: NIKE, Inc., Beaverton, OR (US)

(72) Inventor: Sebastian Huff, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/213,143

(22) Filed: Dec. 7, 2018

(65) Prior Publication Data

US 2019/0104789 A1 Apr. 11, 2019

Related U.S. Application Data

(63) Continuation of application No. 14/618,530, filed on Feb. 10, 2015, now Pat. No. 10,188,164.

(51) Int. Cl.

| | |
|---|---|
| ***A41D 27/28*** | (2006.01) |
| ***A41D 31/00*** | (2019.01) |
| ***A41D 13/015*** | (2006.01) |

(52) U.S. Cl.

CPC ..... *A41D 27/28* (2013.01); *A41D 31/00* (2013.01); *A41D 13/015* (2013.01)

(58) Field of Classification Search

CPC ..... A43B 3/0084; B05C 19/001–004; B29K 2995/0075; D06N 7/0097; D06Q 1/14; Y10T 428/23943; Y10T 428/24273–24347; A41B 2400/20; B32B 3/20; B32B 3/266; B32B 37/0023

USPC ..... 2/181.6, 182.3, 182.8, 209.5, 209.7, 2/DIG. 1; 5/724–725, 625.1–625.2; 156/252, 253, 513, 514, 279; 264/154–156; 427/200, 206, 462–465; 428/131–140, 90

See application file for complete search history.

(56) References Cited

U.S. PATENT DOCUMENTS

| | | | |
|---|---|---|---|
| 2,077,514 | A | 4/1937 | Callahan |
| 5,309,840 | A | 5/1994 | Takamura et al. |
| 7,025,738 | B2 | 4/2006 | Hall |
| 7,043,766 | B1 | 5/2006 | Foreman et al. |
| 8,133,824 | B2 | 3/2012 | Harber |
| 2007/0022510 | A1 | 2/2007 | Chapuis et al. |
| 2007/0293106 | A1 | 12/2007 | Harber |
| 2009/0271914 | A1 | 11/2009 | Bauer |
| 2011/0083246 | A1 | 4/2011 | Vitarana |

(Continued)

FOREIGN PATENT DOCUMENTS

| | | | |
|---|---|---|---|
| WO | 2012138569 | A1 | 10/2012 |

OTHER PUBLICATIONS

Communication under Rule 71(3) dated May 27, 2019 in European Patent Appliction No. 16708817.8, 5 pages.

*Primary Examiner* — Arti Singh-Pandey

(74) *Attorney, Agent, or Firm* — Shook, Hardy and Bacon LLP

(57) ABSTRACT

Concepts provided are directed to garments and methods of making garments with enhanced cooling and airflow. The garments created are provided with airflow channels by lifting the garment off from the skin of a wearer. Particularly, the lift is created in areas of greater contact by providing a flocked silicone dimensional pattern aligned with a plurality of perforations. The enhanced airflow provided by the garments in accordance with aspects hereof also results in enhanced moisture evaporation from the wearer's skin, which also aids in the cooling of the wearer's body.

20 Claims, 5 Drawing Sheets

(56) References Cited

U.S. PATENT DOCUMENTS

| | | | |
|---|---|---|---|
| 2012/0058316 | A1 | 3/2012 | Cherneski |
| 2012/0131720 | A1 | 5/2012 | Nordstrom et al. |

VENTED COOLING GARMENT

CROSS-REFERENCE TO RELATED APPLICATIONS

This application, having attorney docket number 319327/120613US02CON and entitled "Vented Cooling Garment," is a Continuation Application of U.S. patent application Ser. No. 14/618,530, entitled "Vented Cooling Garment," filed Feb. 10, 2015. The entirety of the aforementioned application is incorporated by reference herein.

STATEMENT REGARDING FEDERALLY SPONSORED RESEARCH OR DEVELOPMENT

Not applicable.

TECHNICAL FIELD

Aspects relate to garments with enhanced cooling and airflow. The present invention offers several practical applications in the technical arts, not limited to enhanced comfort for an athlete during physical activity. More particularly, aspects provide a garment with enhanced airflow vents that aid in the cooling and moisture evaporation from a wearer's skin.

BACKGROUND

One of the challenges the human body experiences disrupting a state of comfort is overheating. Heat can commonly come from at least two sources, which include heat from the environment and heat from within the body, particularly when the person is physically exerting his/her body. The body's cooling mechanism when exposed to heat is by evaporation (i.e. sweat). Unfortunately, if the sweat is not able to evaporate from the body's surface as fast as it is being produced, the person's discomfort level can increase rapidly, particularly when his/her garments get wet and subsequently soaked.

Wet garments can become very uncomfortable by impeding proper evaporation of sweat from the body. Additionally, wet garments tend to stick to the body and thereby impede the body's ability to move freely within the garment adversely affecting, for example, an athlete's performance by restricting range of motion. Additionally, failure to properly cool the body by sweat evaporation, particularly in an uncomfortably warm environment, can have adverse health effects on the body, such as heat exhaustion and/or heat stroke.

Mesh fabrics have been integrated in some athletic garments to aid in the evaporative cooling of athletes during physical exertion. However, these mesh fabrics are often not enough to help the athlete stay comfortably dry within the garment, especially in areas of the body such as the shoulders because the material tends to lay flat on the shoulders, not allowing airflow through the mesh.

SUMMARY

Aspects provided herein generally relates to fabrics and/or garments that have lift-off structures in concert with vents that effectively raise the garments away from the surface of a body, creating air channels between the garment and the skin surface of the wearer.

In one aspect, a vented upper body garment is provided, comprising a back panel having an inner surface intended for contacting the skin of a user and an outer surface exposed to the elements or at least opposite the inner surface. The back panel comprises a first region having a plurality of adhesive overlay film structures affixed to the back panel, each adhesive overlay film structure in the plurality of adhesive overlay film structures having a specific shape or pattern. Also included are a plurality of perforations aligning with the plurality of adhesive overlay film structures, each of the perforations extending through each adhesive overlay film structure and the back panel. Each adhesive overlay structure defining a reinforcing perimeter for each of the perforations in the plurality of perforations on the back panel. Additionally, a flocked silicone print is aligned with a perimeter of each perforation in the plurality of perforations in the first region, the flocked silicon extending into a second region.

In another aspect, a method for constructing a vented garment is provided. The method includes the steps of cutting a fabric panel for the garment to be vented or otherwise functionalized. The method also includes cutting a desired pattern formed from a plurality of adhesive overlay structures on a sheet or portion of adhesive overlay film. Consecutively, unwanted portions of the adhesive overlay film are removed from the cut pattern, leaving just the plurality of adhesive overlay structures forming the pattern, in this example. Then, the adhesive overlay structures are temporarily affixed to the adhesive overlay structures, forming the pattern of the overlay structures onto the fabric panel, such that a first region containing the adhesive overlay structures and a second region without the adhesive overlay structures are defined on the fabric panel. A plurality of perforations are cut through the adhesive overlay structures and the fabric panel in the first region, then, the adhesive overlay structures are permanently affixed onto the fabric panel. Finally, silicone is printed or otherwise deposited on the first region and the second region of the fabric panel and flocking is applied to the deposited silicone.

Additional objects, advantages, and novel features of the invention will be set forth in part in the description that follows, and in part will become apparent to those skilled in the art upon examination of the following, or may be learned by practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

Aspects hereof relate to a method of manufacturing a vented garment with effective cooling for regulating the body temperature of a user, especially during activities requiring physical exertion. In another aspect, the present invention relates to the actual garment and the different structural implementations on the interior and exterior surfaces of the garment to achieve the effective cooling. In addition to achieving effective cooling, the different structural implementations on the garment may also add aesthetic 3D visual effects to the garment, making it visually interesting and appealing. Details of the method of manufacturing and an exemplary garment with structural implementations are shown and described in greater detail in reference to the following figures.

Figure 1:
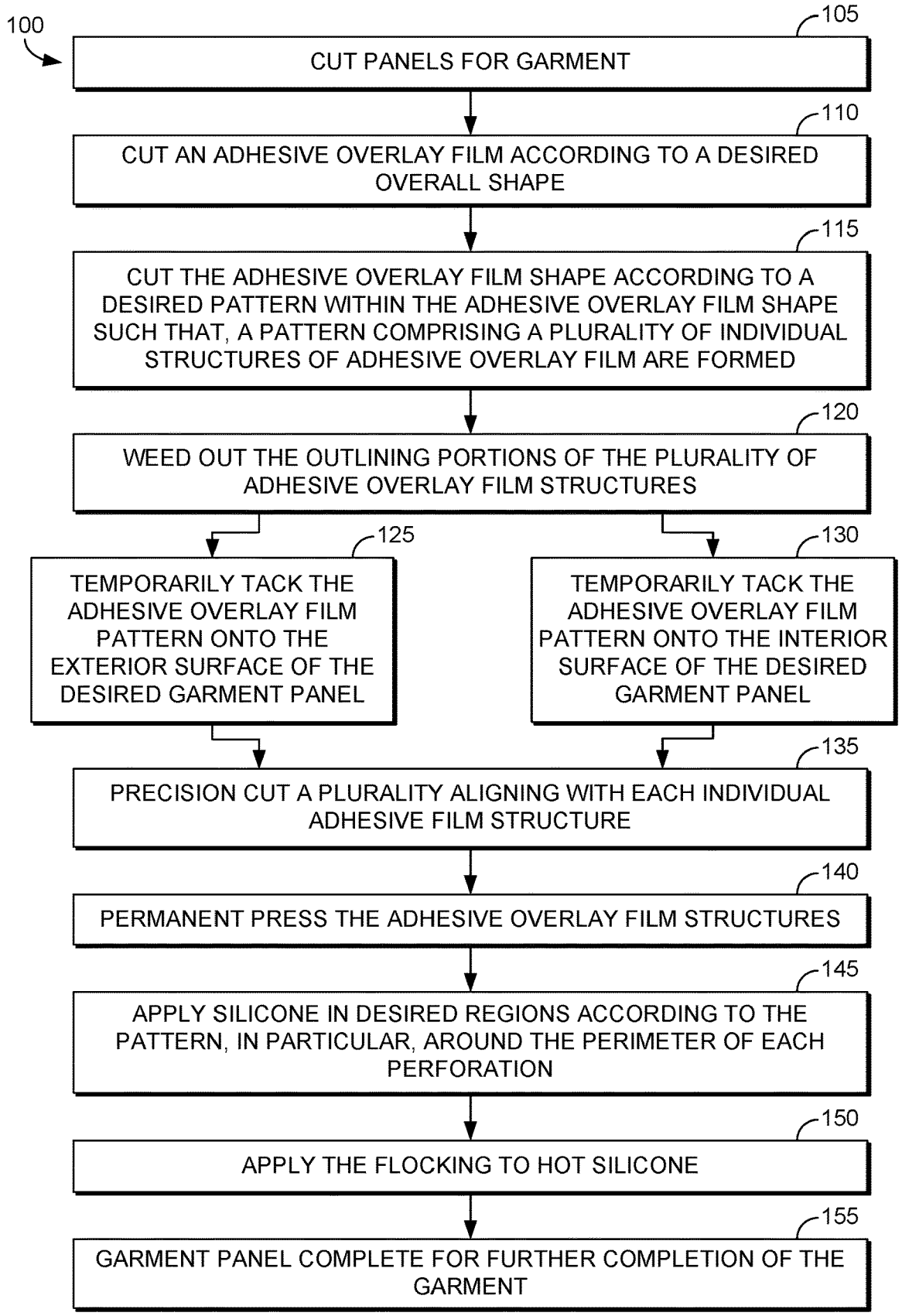
FIG. 1 illustrates a block diagram depicting a method for manufacturing a cooling garment, in accordance with aspects provided herein.

FIG. 1 illustrates a method 100 for manufacturing cooling garments in accordance with aspects hereof. As outlined in FIG. 1, at step 105 the different panels for constructing the garment are cut from a desired fabric/material. Garments may be manufactured from natural fabrics such as cotton or wool, or synthetic fabrics such as polyester, nylon, etc. Fabrics/materials with particular physical properties such as moisture-wicking, heat transfer, stretchability, stiffness, etc., may be used. Additionally, fabrics/materials treated with different types of synthetic coatings such as, moisture management coatings, water repellant coatings, fire retardant coatings, etc., may also be employed in accordance to aspects hereof.

Also discussed herein is an adhesive overlay, which may be a material in a sheet- or film-like state that has an adhesive property on one or more surfaces. For example the material from which the adhesive overlay is formed may be a thermoform or a thermoset material that when heated to a sufficient temperature melts to bond or adhere to an underlying material. Alternatively, a coating or other treatment may be applied to a surface of the adhesive overlay to adhere or bond to the underlying material.

Different garments may require different numbers of fabric panels. At a basic level, for example, for an upper body garment, the upper body garment may require at least a front panel and a back panel. Depending on where the novel vent systems are desired in a garment in accordance with the present invention, an adhesive overlay film may be cut at step 110 according to an overall shape. Consecutively, the adhesive overlay film may be cut according to a desired pattern within the overall shape, at step 115. The pattern within the overall shape may comprise a plurality of individual structures that fit within the overall shape. As used herein, the term "cut" may represent any process that separates or otherwise removes a portion of material from a greater portion of the material. This may be accomplished with scissors, knives, dies, lasers, water jets, and the like.

The plurality of individual structures formed within or forming the pattern may be all the same size, or alternatively, they may be of different sizes according to their location within the overall structure. When the plurality of individual structures are of different sizes, they may be formed according to a relative size gradient going from small to big, where the bigger individual structures are placed at a location on the fabric panel closer to a region where the air flow into the completed garment may be optimized. Stated differently, the larger structures may be positioned on a garment in a location at which a great volume of airflow is desired, in an exemplary aspect.

At step 120, the portions of the adhesive overlay film that outline the plurality of individual structures may be removed or separated such that only the individual adhesive overlay film structures remain, forming the desired shape and desired pattern within the desired shape. In an exemplary aspect, it is contemplated that a carrier sheet on which the adhesive overlay is positioned remains after the removal of the outline portion such that the individual structures are maintained in a relative position to one another on the carrier material until adhered/tacked to a garment panel. Consecutively, the individual adhesive overlay film structures may be temporarily tacked (e.g., adhered, maintained) to either the exterior surface of the selected garment panel at step 125, or, the individual adhesive overlay film structures may be temporarily tacked to the interior surface of the selected garment panel at step 130. The adhesive overlay film structure may be temporarily tacked by, for example, manually ironing (or other heat application means) over the film backing at a temperature optimal for temporary tacking of the adhesive overlay film or providing a temporary adhesive layer on the adhesive overlay film. The interior surface of the selected garment in accordance with the present invention is the surface contacting the skin of the user, whereas the exterior surface of the selected garment panel is the surface exposed to the elements, in exemplary aspects hereof.

The adhesive overlay film may be clear, or in the alternative, may comprise a specific color, or may comprise multiple colors. Furthermore, when the adhesive overlay film is to be applied to the exterior surface of the garment panel, the adhesive overlay film may comprise multiple colors that form patterns, shiny elements, fluorescent elements, color-changing properties according to an external stimuli, etc. for enhancing visual appeal and providing functional advantages such as identification characteristics.

Once the individual adhesive overlay film structures are set in place either temporarily or permanently on the garment, the garment panel is subjected to perforation, or precision cutting of holes within the space occupied by each individual adhesive overlay film structure, leaving a perimeter of adhesive overlay film around each perforation or hole at step 135. The perforation/hole extends through the adhesive overlay and the material on to which the overlay is adhered. The perforations may be formed by different methods provided above such as die-cutting, laser cutting, manual cutting, etc.

Once the perforations or holes are cut through each individual adhesive overlay film structure, the adhesive overlay film may be permanently pressed onto the garment panel at step 140. This may be achieved by, for example, applying heat via a permanent press at a temperature optimal for achieving a permanent bond between the adhesive overlay film structure and the garment panel. It is contemplated that a single adhesion step may be performed in an exemplary aspect, such that a secondary process to achieve permanent adhesion is not implemented, in an exemplary aspect.

At step 145, silicone may be printed or otherwise deposited around each individual adhesive overlay film structure. This printing of the silicone defines a first zone where the silicone may be printed at a first weight, or at a first continuity pattern. Additionally, silicone may be printed beyond the first zone, defining a second zone. In the second zone, the silicone may be printed at a second weight, or at a second continuity pattern. Further, in additional aspects, the silicone may be printed to as many zones as desired at the desired weight and continuity for that particular zone. The weight of the silicone print may affect the thickness and/or the height of the print extending from the material/overlay surface, while the continuity may affect whether, for example, a continuous line is to be printed, or a dotted, dashed, intermittent, etc. line is to be printed. The term "print" represents a deposition of material by a number of techniques and systems. For example, the silicone may be deposited through a computer-controlled applicator that controls the location and quantity of silicone deposited. Similarly, the silicone may be applied by human, in an exemplary aspect.

In accordance with aspects hereof, the silicone is applied to the interior surface of the garment panel to create a lift off (e.g., separation) from the user's skin such that channels may be formed between the user's skin and the garment panel for airflow and cooling. Then, at step 150, when the silicone is still uncured or in other words, not set yet, flocking may be applied to the printed silicone to reduce the coefficient of friction between the user's skin and the garment at the silicone. Stated differently, the flocking may be useable for preventing the silicone from sticking and/or clinging directly onto the user's skin. Eliminating the sticking and/or clinging of the garment onto the user's skin may also allow the garment to move freely, also creating added airflow by each movement of the garment according to the movements of the user.

As used herein, "flocking" is a process of depositing small particles, referred to as flock on to a surface. The flock may be any material, such as synthetic or natural fibers. For example, in an exemplary aspect, the flock may be a polyester, nylon, or other synthetic fiber element that is able to be secured by a silicone to the garment/overlay surface.

Figure 2:
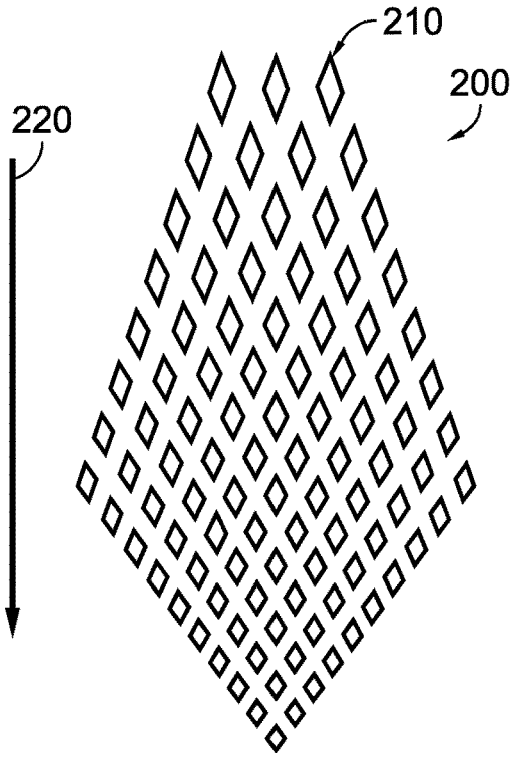
FIG. 2 illustrates an exemplary pattern for an adhesive overlay film with a plurality of individual overlay film structures, in accordance with aspects hereof.

FIG. 2 illustrates an exemplary shape and pattern created from an adhesive overlay film, comprising a plurality of individual overlay film structures, in accordance with aspects hereof. As outlined in the method of FIG. 1, the individual adhesive overlay film structures may be affixed to a garment panel. In the exemplary pattern 200 shown in FIG. 2, the individual adhesive overlay film structures 210 form the overall pattern 200, which may be affixed to a garment panel. In this illustration, the outlining portions of the adhesive overlay have been removed leaving only the individual adhesive overlay film structures. In this example, the pattern 200 may be affixed to the back panel of an upper body garment. The overall pattern 200 may have a maximum length ranging from 1 cm to 35 cm and a maximum width ranging from 1 to 35 cm, at the tallest and widest points in the overall pattern 200, in an exemplary aspect. The overall pattern 200 may have a maximum length and width ranging from 5 cm to 35 cm, a maximum length and width ranging from 5 cm to 30 cm, a maximum length and width ranging from 10 cm to 25 cm, a maximum length and width ranging from 5 cm to 25 cm, etc. depending on the location on the garment and the type of garment where the overall pattern 200 will be provided.

The maximum length of the overall pattern 200 may be the same as the maximum width of the overall pattern 200, for example in the case of a circle, square, equilateral diamond, or any other organic or geometric shape. Or, alternatively, the maximum length of the overall pattern 200 may be different from the maximum width of the overall pattern 200, for example in the case of a rectangle, oval, or any other organic or geometric shape.

The overall pattern 200 in this example is an upside-down diamond shape; however, the shape may be round, rectangle, oval, or any other desired shape for the particular garment and location on the garment. Further, the individual adhesive overlay film structures 210 may be of a uniform size, or alternatively may comprise different sizes (as shown). If different sizes are desired, the individual adhesive overlay structures may be arranged in any desired way according to the shape and pattern to be formed. For example, in FIG. 2, the individual adhesive overlay film structures are organized in a gradient 220, for example, from big to small, from a top edge to a bottom edge of the back panel. Each individual adhesive overlay film structure may have a length and a width ranging from 0.1 cm to 4 cm, 0.1 cm to 3 cm, 0.5 cm to 4, 0.5 to 2, etc.

When applied to the garment panel as shown later in FIG. 5, the gradient 220 serves to maximize airflow at the top of the garment where there is higher contact of the garment with the user's skin, while still providing airflow through the bottom of the garment, where airflow may be inherently higher due to the bottom opening of the upper body garment, which receives a person's upper body, especially for garments that are meant to have a loose fit. Each individual adhesive overlay film structure 210 may also have a particular individual shape for matching the overall shape 200. In FIG. 2, each individual overlay film structure 210 has a diamond shape. However, depending on the overall shape 200, each individual film structure 210 may be a circle, star, triangle, square, rectangle, semi-circle, crescent, etc., or any other shape optimal for providing maximum airflow through the garment, while also contributing to the visual appeal of the garment.

Additionally, the adhesive overlay film may be clear or colored; it may be smooth or textured; it may be matte or glossy; it may include reflective pigments, fluorescent pigments, etc. The adhesive overlay film may have a combination of colors, patterns, textures, etc. The adhesive overlay film may be applied to the outer surface of the garment panel; the adhesive overlay film structure may be applied to the inner surface of the garment panel; or alternatively, the adhesive overlay film structure may be applied to both the inner and outer surface of the garment panel. When applied to the inner surface of the garment panel, the flocked silicone print may be printed on top of the adhesive overlay film, whereas if the adhesive overlay film is applied only to the outer surface of the garment panel, the flocked silicone print may be printed directly on the inner surface of the garment panel. With the versatility of the adhesive overlay film in terms of color and texture, the adhesive overlay film may also be used for enhancing a visual appeal for the garment.

Figure 3:
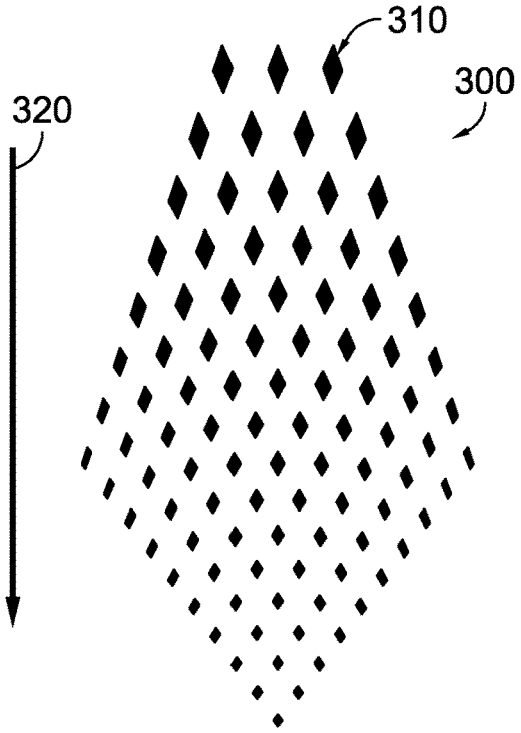
FIG. 3 illustrates an exemplary pattern of a plurality of perforations that align with the plurality of individual overlay film structures of FIG. 2, in accordance with aspects hereof.

FIG. 3 illustrates how a plurality of perforations 300, with individual perforations 310 are formed and arranged in a gradient 320, matching the gradient 220 for the plurality of adhesive film structures, in accordance with aspects hereof. Preferably, each individual perforation 310 is formed in the center of each individual adhesive overlay film structure 210 such that once the perforation is formed through both the garment panel and the adhesive film structure. Stated more broadly, the perforation 310 may be generally associated with a respective adhesive overlay film structure. The remaining adhesive film around the perimeter of each perforation serves as a protective barrier against deterioration of each individual perforation. In other words, the adhesive film surrounding each individual perforation serves as a reinforcing perimeter for each individual perforation 310 so that each perforation 310 is able to maintain its shape even after normal wear, including normal repeated wash cycles, thereby preventing premature ripping of the garment (e.g., underlying material), particularly at the plurality of perforations 300. Further, it is contemplated that the adhesive overlay structures when adhered to the garment are effective for preventing fraying or other structural failures of a knit or woven textile. Each individual perforation 310 may have the same general shape as the corresponding adhesive overlay film structure 210. In this instance, each individual perforation 310 may be at least 0.5 mm smaller in every direction than the corresponding adhesive overlay film structure 210. Stated differently, the adhesive overlay film structure may form a perimeter around the perforation, such as a 0.5 mm between the edge of the adhesive overlay structure and the edge of the associated perforation. Alternatively, the individual perforations 310 may have a first shape and the corresponding individual adhesive overlay film structures 210 may have a second shape different from the first shape (not shown). In other words, the adhesive overlay film structure 210 may have a round, oval, square, or any other organic or geometric shape, while the perforation 310 may have a second shape that is different from the first shape. For example, the adhesive overlay film structure may have a round shape, while the perforation 310 may have a star shape.

Figure 4:
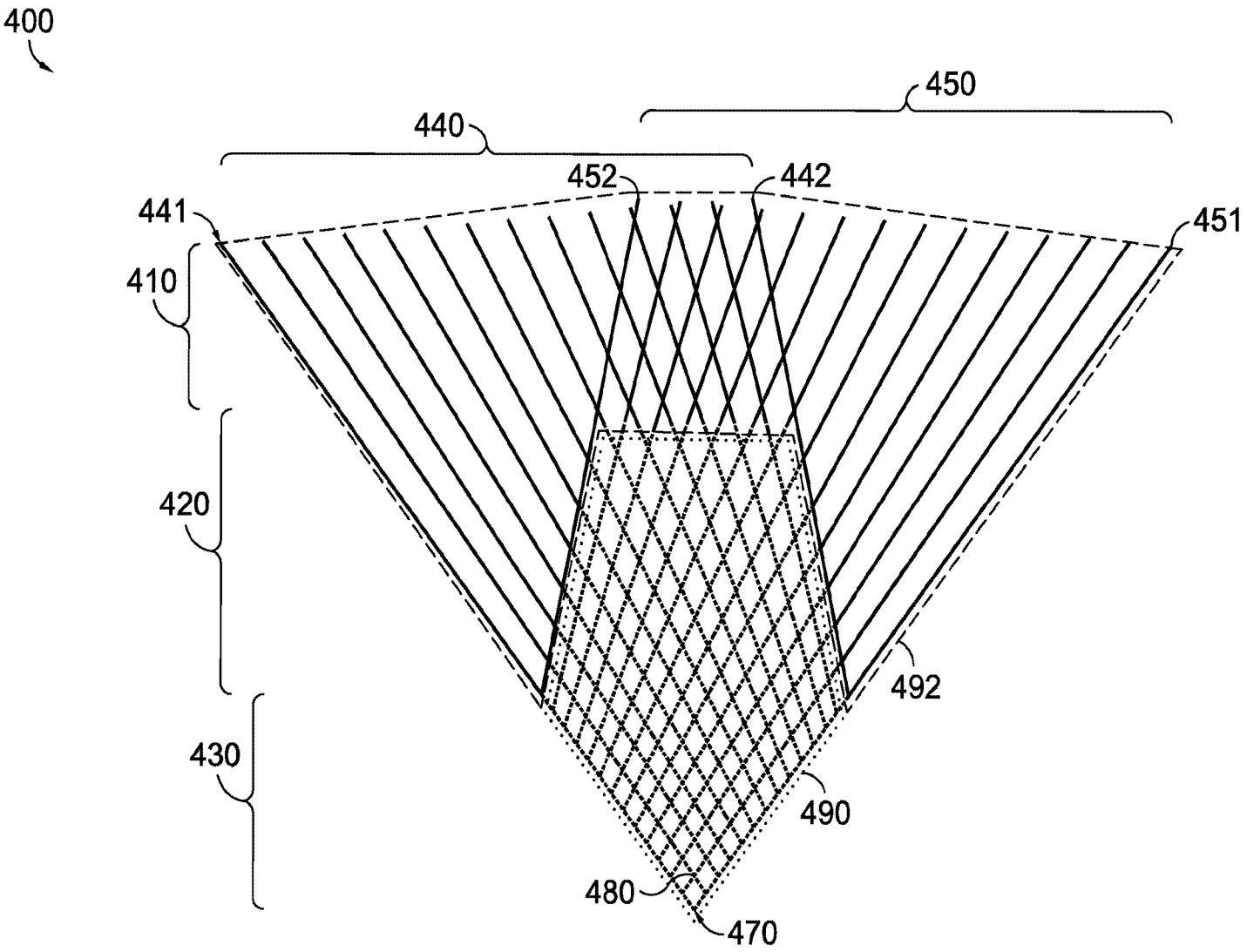
FIG. 4 illustrates a deposited silicone pattern corresponding to the exemplary patterns of FIGS. 2 and 3, wherein the deposited silicone is shown to have a first continuity in a first region and a second continuity in a second region, in accordance with aspects hereof.

FIG. 4 is an exemplary representation of a silicone print pattern 400 for the overall shape 200 presented in FIGS. 2 and 3, in accordance with aspects hereof. One of ordinary skill in the art would recognize that the silicone print pattern 400 would change depending on the overall shape 200. There are at least two main regions for the silicone print, where in a first region, the silicone print is continuous, and in a second region, the silicone print is broken/dotted (e.g., discontinuous). The continuous silicone printed region may, for example, be aligned with areas on the garment/overlay surface that may require higher lift, or more support. The broken/dotted silicone printed regions, on the other hand, may for example, be aligned with areas on the garment/overlay surface that require increased airflow. In the provided aspect there are three main zones in the silicone print pattern 400. A first zone 410, comprising a continuous silicone print, a second zone 420 comprising both a broken/dotted silicone print area and a continuous silicone print area, and finally, a third zone 430 comprising only a broken/dotted silicone print area. There are several parameters that may be adjusted to achieve a desired functional result in the silicone print including the thickness and the weight/height of the silicone print pattern 400. In this particular example, the silicone print pattern 400 is formed by a series of non-parallel lines divided into two groups traveling in opposite directions. The non-parallel lines in group one shown as 440 and the non-parallel lines in group two shown as 450, form and are included within an upside down triangular shape. For the pattern 400, group one 440 and group two 450 consist of 14 lines each in this example; however, any number of lines in any combination may be implemented. The main upside-down triangle is formed by the first line 441 in group one and the first line 451 in group two, which meet at the lowest point of the upside-down triangle 470. Each line of the first group 440 emanates from the line 451 at an angle non-perpendicular to the line 451. Further, the farther away from point 470 that a line in the group one 440 begins, the greater the obtuse angle between the emanating line of group one 440 and the line 451. A similar relationship also is presented with the group two 450 extending from line 441.

Each line in group one 440 comprises a broken/dotted silicone print region closer to the point 470 and a solid print region closer to the opposite end of the line. The broken/dotted region and the solid region in the first 7 lines in group one are delimited by the last line 452 in group two and similarly, the broken/dotted region and the solid region in the first 7 lines in group two are delimited by the last line 442 in group one. Both lines 452 and 442 comprise a solid print throughout. For the rest of the lines in each group, the broken/dotted print region and the solid print region are delimited by a non-physical line that divides the first zone 410 from the second zone 420. The silicone print pattern 400 is such that each line in group one 440 are evenly spaced apart in a fanning out fashion in a first direction and intersecting with the lines in group two 450, which are also evenly spaced apart in a fanning out fashion in a second direction opposite the first direction. Further, proximate the plurality of perforations 300, the broken/dotted silicone print region aids in keeping all the air channels formed by the silicone print in communication with each other.

Figure 5:
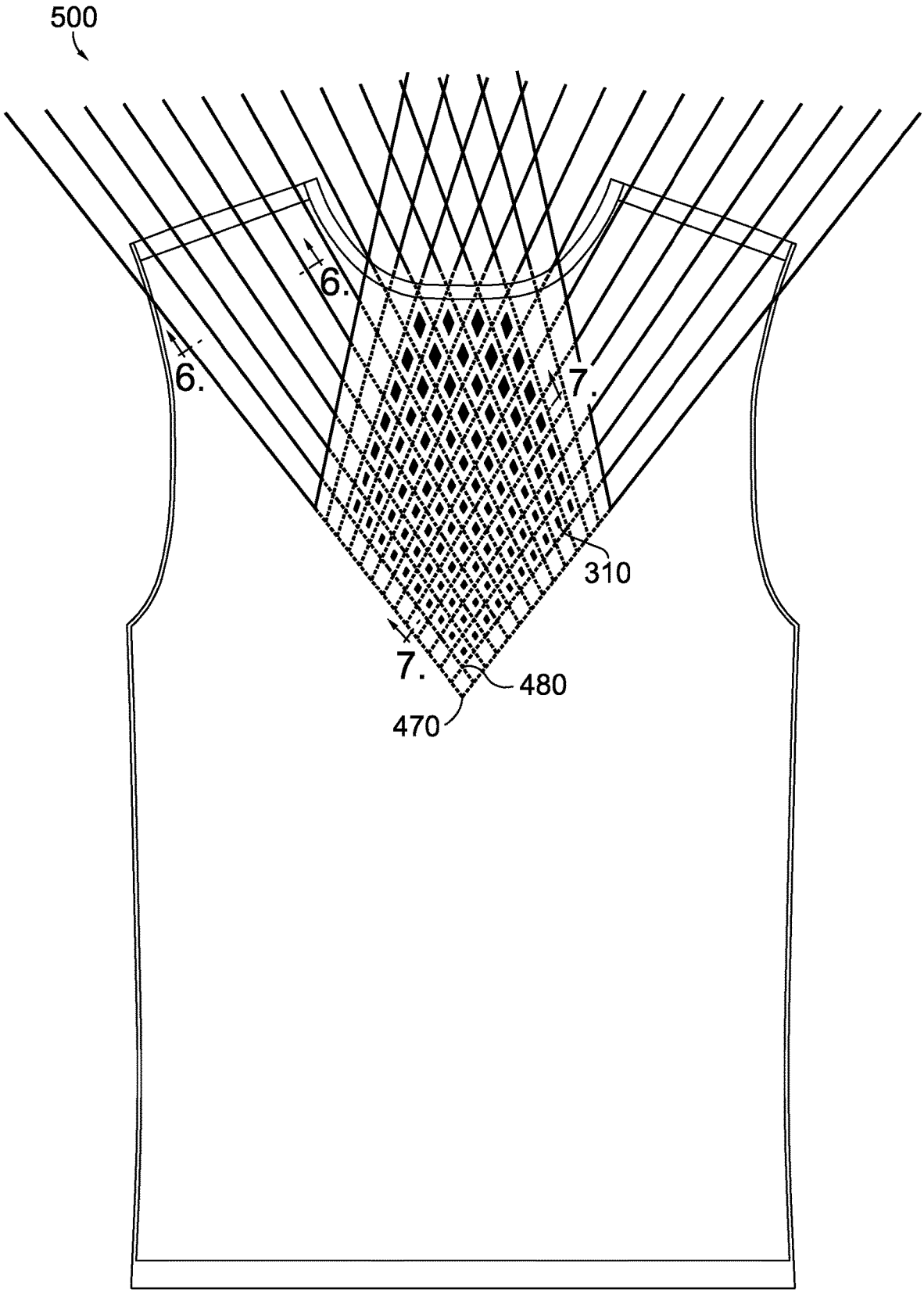
FIG. 5 illustrates the plurality of adhesive overlay film structures, the plurality of perforations, and the printed silicone may align when oriented on an upper body garment panel, in accordance with aspects hereof.

FIG. 5 illustrates the silicone print pattern 400 in FIG. 4, and the plurality of perforations 300 in FIG. 3 aligned with a back panel of an exemplary sports garment back panel 500, in accordance with aspects hereof. As shown in FIG. 5, the silicone print pattern 400 aligns with the shoulder and upper back region of the garment. The plurality of perforations 300 are located in the middle of the back panel, aligning with the broken/dotted silicone print in the second zone 420 and the third zone 430, as described in FIG. 4. The lift-off is created by the solid silicone print in the first zone. The lift-off solid silicone print may for example be present only in the garment back panel 500 or, in a different example (not shown), the lift-off solid silicone print may extend to the shoulder region of the garment front panel to create lift-off at least on top of the shoulder region of the garment. An aspect of the alignment of the silicone print pattern 400 and the plurality of perforations 300 is that the plurality of perforations 300 are offset from the silicone print pattern 400. In other words, the plurality of perforations 300 align with the second lowest point 480 in the upside-down triangle formed by silicone print pattern 400 instead of the lowest point 470. This offset may allow improved air circulation within the garment by providing additional room for the circulation of air coming in and going out of the garment, particularly as the garment becomes saturated with sweat and therefore has a greater tendency to weigh down, increasing the tendency of the garment to stick to the body.

Figure 6:
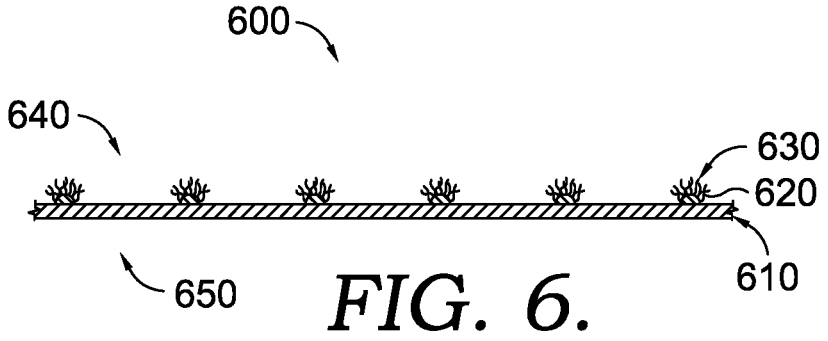
FIG. 6 illustrates a cross section along line 6-6 of FIG. 5, in accordance with aspects hereof.

FIG. 6 is a cross-section 600 of the garment panel shown in FIG. 5 along line 6-6, in accordance with aspects hereof. As described earlier in reference to FIG. 1, the silicone print is subsequently subjected to flocking to prevent, for example, the silicone printed regions from sticking to the wearer's skin. As shown in FIG. 6 in the first zone 410 and the second zone 420 from FIG. 4 where the silicone print is solid, the silicone is printed directly onto the inner surface of the garment panel 610. In other words, garment panel 610 has an inner surface 640 and an outer surface 650. The silicon print 620 is printed directly onto the inner surface 640 of the garment panel 610 and subsequently, the silicone print 620 is flocked 630. As described earlier, the silicone may be printed at different weights (height of lift-off) and widths. For example, the silicone may be printed at a greater weight in the areas corresponding to greater skin contact (for example, in the case of an upper body garment, this would be on top of the shoulders). The weight of the silicone print may be uniform throughout the silicone print pattern 400, or it may be changed gradually and uniformly in one direction. Alternatively, the weight may be changed in steps; for example, the silicone print may be one weight in the solid print regions and a different weight in the broken/dotted print regions. In this example, each of the silicon print lines is printed at the same weight and width.

Figure 7:
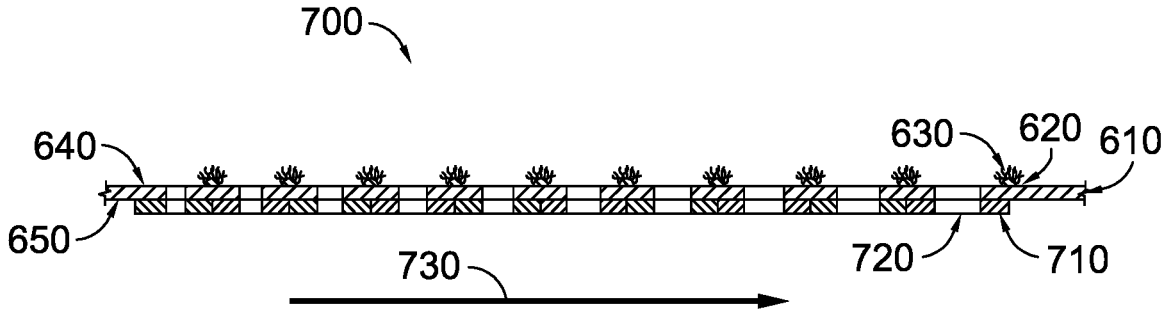
FIG. 7 illustrates a cross section along line 7-7 of FIG. 5, in accordance with aspects hereof.

FIG. 7 is a cross-section 700 of the garment shown in FIG. 5 along line 7-7, where the garment comprises the plurality of perforations 720, in accordance with aspects hereof. In this example, the silicone 620 is printed and flocked 630 directly onto the inner surface 640 of the garment panel 610. The adhesive overlay film 710 on the other hand, is applied directly on the outer surface 650 of the garment panel 610. Also, FIG. 7 clearly shows the size gradient 730 for the plurality of perforations 720 going from small to large. Also, it can be clearly appreciated from FIG. 7 that the adhesive film structure surrounds each perforation 720, forming a reinforcing perimeter around each perforation 720, for the garment panel 610 at each perforation 720.

Figure 8:
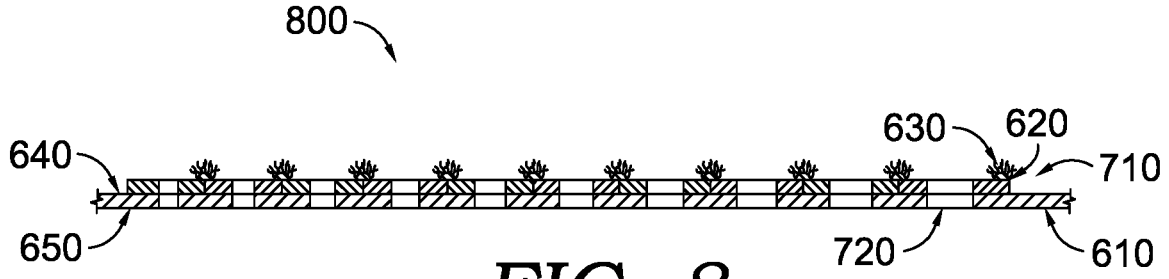
FIG. 8 is an alternative cross section of a garment, in accordance with aspects hereof.

FIG. 8 is an alternative example 800 of a cross-section similar to that of cross-section 700 shown in FIG. 7, where the adhesive overlay film 710 is applied to the inner surface 640 of the garment panel 610, in accordance with aspects hereof. Consequently, the silicone print 620 is printed on the adhesive overlay film 710 and subsequently flocked 630.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments of the invention may be made without departing from the scope thereof, it is to be understood that all matter herein set forth or shown in the accompanying drawings is to be interpreted as illustrative and not in a limiting sense.

The invention claimed is:

1. A vented upper body garment, comprising:

a back panel comprising an inner surface and an outer surface opposite the inner surface, the back panel further comprising a first region and a second region, wherein:

the first region comprises a first plurality of overlay film structures affixed to the outer surface of the back panel, each overlay film structure in the first plurality of overlay film structures having a shape;

the each overlay film structure in the first plurality of overlay film structures comprises a perforation, wherein the perforation extends through the each overlay film structure in the first plurality of overlay film structures and the back panel; and a silicone pattern deposited on the inner surface of the back panel, wherein the silicone pattern is aligned with a perimeter of the perforation extending through the each overlay film structure in the first plurality of overlay film structures, wherein the silicone pattern extends into the second region of the back panel.

2. The vented upper body garment of claim 1, wherein the silicone pattern further comprises flocking.

3. The vented upper body garment of claim 1, wherein the silicone pattern comprises an intermittent linear pattern in the first region and a continuous linear pattern in the second region.

4. The vented upper body garment of claim 1, wherein the first region further comprises a second plurality of overlay film structures affixed to the inner surface of the back panel.

5. The vented upper body garment of claim 4, wherein the perforation extends through the each overlay film structure in the first plurality of overlay film structures, the back panel, and each overlay film structure in the second plurality of overlay film structures.

6. The vented upper body garment of claim 1, wherein the first plurality of overlay film structures in the first region form a pattern having a length extending in a lengthwise direction on the back panel and a width in a widthwise direction on the back panel, the length and the width each ranging from 1 to 35 cm, wherein the lengthwise direction extends from a top edge to a bottom edge of the back panel, and wherein the widthwise direction extends perpendicular to the lengthwise direction.

7. The vented upper body garment of claim 1, wherein the first plurality of overlay film structures are substantially uniform in size throughout the first region.

8. The vented upper body garment of claim 1, the back panel further comprising a top edge and a bottom edge, wherein a size of each of the overlay film structures in the first plurality of overlay film structures is gradually decreased in a direction extending from the top edge toward the bottom edge of the back panel.

9. The vented upper body garment of claim 1, wherein each overlay film structure in the first plurality of overlay film structures has a length and a width ranging from 0.1 cm to 4 cm.

10. The vented upper body garment of claim 1, wherein the perforation extending through the each overlay film structure in the first plurality of overlay film structures has a length and a width that is at least 0.5 mm smaller than the each overlay film structure in the first plurality of overlay film structures.

11. A method for constructing a vented garment, the method comprising the steps of:

forming a back panel for the vented garment from a piece of textile, the back panel comprising a first region and a second region;

forming a plurality of overlay structures from an overlay film, wherein the plurality of overlay structures form a pattern;

affixing the plurality of overlay structures onto an outer surface of the first region of the back panel;

forming a perforation through each overlay structure in the plurality of overlay structures and through the back panel; and depositing silicone onto an inner surface of the first region of the back panel, and proximate to a perimeter of the perforation extending through the each overlay structure in the plurality of overlay structures.

12. The method of claim 11, wherein the perforation is formed by one of laser cutting or die cutting.

13. The method of claim 11, further comprising applying flocking to the deposited silicone.

14. The method of claim 11, wherein a size of the plurality of overlay structures is gradually decreased, forming a gradient in a chosen direction.

15. The method of claim 11, wherein each overlay structure in the plurality of overlay structures is temporarily affixed onto the panel prior to the forming of the perforation, and wherein the each overlay structure in the plurality of overlay structures is permanently affixed onto the back panel subsequent to the forming the perforation.

16. The method of claim 15, wherein the silicone deposited proximate to the perimeter of the perforation comprises an intermittent linear pattern.

17. A garment, comprising:

at least one textile panel comprising an inner surface and an outer surface opposite the inner surface;

the inner surface of the at least one textile panel comprising a first region having a first pattern of deposited silicone, wherein the first pattern of deposited silicone comprises a first height of the deposited silicone in the first region; and the inner surface of the at least one textile panel comprising a second region having a second pattern of deposited silicone, wherein the second pattern of deposited silicone comprises a second height of the deposited silicone in the second region, wherein the first height of the deposited silicone in the first region is a different height from the second height of the deposited silicone in the second region.

18. The garment of claim 17, wherein the first pattern of deposited silicone and the second pattern of deposited silicone further comprise flocking.

19. The garment of claim 17, wherein the first pattern of deposited silicone comprises a different pattern from the second pattern of deposited silicone.

20. The garment of claim 19, wherein the first pattern of deposited silicone comprises a continuous line of deposited silicone, and wherein the second pattern of deposited silicone comprises a dotted line of deposited silicone.

* * * * *